US007640976B2

(12) United States Patent
Filippov

(10) Patent No.: US 7,640,976 B2
(45) Date of Patent: Jan. 5, 2010

(54) METHOD AND APPARATUS FOR DOWNHOLE TUBULAR EXPANSION

(75) Inventor: Andrei Gregory Filippov, Houston, TX (US)

(73) Assignee: Mohawk Energy Ltd., Houston, TX (US)

( * ) Notice: Subject to any disclaimer, the term of this patent is extended or adjusted under 35 U.S.C. 154(b) by 58 days.

(21) Appl. No.: 11/577,229

(22) PCT Filed: Nov. 7, 2006

(86) PCT No.: PCT/US2006/060624

§ 371 (c)(1),
(2), (4) Date: Apr. 13, 2007

(87) PCT Pub. No.: WO2007/056732

PCT Pub. Date: May 18, 2007

(65) Prior Publication Data

US 2009/0229835 A1 Sep. 17, 2009

Related U.S. Application Data

(60) Provisional application No. 60/734,153, filed on Nov. 7, 2005.

(51) Int. Cl.
*E21B 23/04* (2006.01)

(52) U.S. Cl. ..... 166/212; 166/380

(58) Field of Classification Search ..... 166/206, 166/207, 212, 215, 297, 380, 382
See application file for complete search history.

(56) References Cited

U.S. PATENT DOCUMENTS 2,350,973 A 6/1944 Brumleu et al.
3,191,668 A 6/1965 Lorenz
3,191,680 A 6/1965 Vincent
3,203,451 A 8/1965 Vincent (Continued)

FOREIGN PATENT DOCUMENTS

WO WO2004/099561 11/2004

OTHER PUBLICATIONS

PCT International Search Report for International Application No. PCT/US06/60624 dated Feb. 22, 2008.

(Continued)

*Primary Examiner*—Jennifer H Gay
*Assistant Examiner*—Daniel P Stephenson
(74) *Attorney, Agent, or Firm*—Tumey L.L.P.

(57) ABSTRACT

A method and apparatus for expanding tubulars are disclosed. In one embodiment, an apparatus for radially expanding a tubular in a wellbore is disclosed. The apparatus includes an expansion swage. In addition, the apparatus includes at least one anchoring device for selective and releasable anchoring of selected parts of the apparatus to an inner surface of the tubular. The apparatus also includes a thruster providing a force for longitudinal movement of the expansion swage inside the tubular. Moreover, the apparatus includes a hydraulic valve for selective control of a flow of operating fluid to the thruster. The hydraulic valve includes a valve cylinder slidably positioned on a shaft and a position control device for selective and releasable securing a position of the valve cylinder on the shaft. The hydraulic valve also includes an elastic device for shifting the valve cylinder between two end positions.

20 Claims, 3 Drawing Sheets

U.S. PATENT DOCUMENTS

| | | | |
|---|---|---|---|
| 4,678,035 | A | 7/1987 | Goldschild |
| 5,348,095 | A | 9/1994 | Worrall et al. |
| 5,785,120 | A | 7/1998 | Smalley et al. |
| 6,085,838 | A | 7/2000 | Vercaemer et al. |
| 6,631,759 | B2 | 10/2003 | Cook et al. |
| 6,631,769 | B2 | 10/2003 | Cooke et al. |
| 6,640,903 | B1 | 11/2003 | Cook et al. |
| 6,695,012 | B1 | 2/2004 | Ring et al. |
| 6,892,819 | B2 | 5/2005 | Cook et al. |
| 7,172,019 | B2 | 2/2007 | Cook et al. |
| 7,185,701 | B2 | 3/2007 | MacKenzie |
| 2002/0060069 | A1 | 5/2002 | Cook et al. |
| 2003/0168222 | A1 | 9/2003 | Maguire et al. |
| 2003/0196818 | A1 | 10/2003 | Lynde et al. |
| 2004/0040721 | A1 | 3/2004 | Maguire et al. |
| 2004/0112589 | A1 | 6/2004 | Cook et al. |
| 2004/0149442 | A1 | 8/2004 | Mackenzie |
| 2005/0126251 | A1 | 6/2005 | Oosterling et al. |

OTHER PUBLICATIONS

PCT Written Opinion for International Application No. PCT/US06/60624 dated Feb. 22, 2008.

PCT International Search Report and Written Opinion for International Application No. PCT/US07/64999 dated Sep. 9, 2008.

PCT International Preliminary Report on Patentability for International Application No. PCT/US2007/064999 dated Oct. 9, 2008.

Notice of Allowance for U.S. Appl. No. 11/691,375 dated Dec. 3, 2008.

GB Examination Report for Application No. GB0814724.1 dated Nov. 28, 2008.

Office Action, Canadian Patent Office, Canadian Serial No. 2,638,035, dated Jul. 2, 2009.

PCT International Preliminary Report on Patentability for International Serial No. PCT/US2006/060624, Dated May 7, 2008 (5 p.).

USPTO Office Action for U.S. Appl. No. 11/734,167, Dated May 30, 2008.

USPTO Office Action for U.S. Appl. No. 11/691,375, Dated Aug. 4, 2008.

USPTO Office Action for U.S. Appl. No. 11/734,167, Dated Aug. 26, 2008.

Notice of Allowance issued for U.S. Appl. No. 11/734,167, filed Apr. 11, 2007.

METHOD AND APPARATUS FOR DOWNHOLE TUBULAR EXPANSION

CROSS REFERENCE TO RELATED APPLICATIONS

This application is a non-provisional application that claims the benefit of U.S. Application Ser. No. 60/734,153 filed on Nov. 7, 2005, which is incorporated by reference herein in its entirety.

BACKGROUND OF THE INVENTION

1. Field of the Invention

This invention relates to the field of expandable tubulars and more specifically to a method and apparatus for running downhole tubulars of a diameter smaller than the size of the casing already installed in the wellbore and expanding the tubular to a larger diameter downhole.

2. Background of the Invention

Expandable tubulars have become a viable technology for well drilling, repair, and completion. In one technique, the expandable tubular string has a pre-expanded portion (e.g., expansion swage launcher) at the bottom of the string with the expansion swage inserted in the launcher. Hydraulic pressure may be applied through a drill pipe to an area below the expansion swage to generate a force for propagation of the swage through the tubular and subsequent expansion of the tubular. One drawback of this technique is the safety aspect of the operation at the end of the expansion process. For instance, when the expansion swage is exiting from the expanded tubular (e.g., "pop-out" point), the entire volume of expanded tubular may be under the high pressure, and the tubular may be radially and longitudinally stretched by the pressure. The expandable tubular string typically employed may have a length of several thousand feet and may be expanded by applying three thousand to five thousand pounds per square inch of pressure. The combined energy of the compressed liquid and of the elastically stretched tubular, when instantly released at the pop-out point, may propel the drill pipe with the expansion swage acting as a piston out of the well causing equipment damage and injuries to the rig personnel.

Another technique includes an expansion device having an expansion cone, an actuator capable of displacing the expansion cone, and two end anchors capable of preventing movement of the actuator when the expansion cone is displaced. A drawback of this device is that it may not reset automatically. For instance, the repeated steps of application and withdrawal of hydraulic pressure to the whole system, including drill pipe, are time consuming, uneconomical in operation, and not suitable for expanding long tubulars. Techniques have been developed to overcome such drawbacks. For instance, techniques include an expansion device that includes an expansion cone, an actuator, two or three anchoring devices as well as a sliding valve that may automatically reset the actuator. The sliding valve may be positioned in an annular chamber of a double-walled cone-guide shaft. In addition, the sliding valve may be displaced between a front position, in which the valve passage is at the front side of the actuator piston, and a rear position, in which the valve passage is at the rear side of the actuator piston. Drawbacks to such a design include that the valve does not provide passage for the liquid out of the chamber on one side of the piston when the pressure is applied in the chamber on the other side of the piston, which may create a pressure lock and make the actuator in-operational. Further drawbacks include that the modification of such valve design, in order to incorporate fluid passage out from one side of the actuator piston and pressure fluid entering on the other side of the actuator piston simultaneously, may be difficult because the sliding valve provides communication with high pressure line only.

Therefore, there is a need for a safe and efficient technique of tubular radial expansion in downhole conditions.

BRIEF SUMMARY OF SOME OF THE PREFERRED EMBODIMENTS

These and other needs in the art are addressed in one embodiment by an apparatus for radially expanding a tubular in a wellbore. The apparatus comprises an expansion swage and at least one anchoring device for selective and releasable anchoring of selected parts of the apparatus to an inner surface of the tubular. The apparatus also comprises a thruster providing a force for longitudinal movement of the expansion swage inside the tubular. In addition, the apparatus includes a hydraulic valve for selective control of a flow of operating fluid to the thruster. The hydraulic valve includes a valve cylinder slidably positioned on a shaft and a position control device for selective and releasable securing a position of the valve cylinder on the shaft. In addition, the hydraulic valve includes an elastic device for shifting the valve cylinder between two end positions.

In addition, these and other needs in the art are addressed by a method for placing and expanding an expandable tubular in a cased or an open hole wellbore. The method comprises delivering the tubular and a tubular expansion apparatus to a desired location in the wellbore on a conduit having a path for conveying fluid to the tubular expansion apparatus. The method further includes providing an expansion swage. In addition, the method includes providing a first anchoring device connected to the expansion swage. The method also includes providing a second anchoring device connected to a shaft. Moreover, the method includes providing a thruster for providing a force for longitudinal movement of the expansion swage inside the tubular and expanding the tubular. The method also includes providing a hydraulic valve for automatically alternating pressure fluid delivery and withdrawal to the thruster. The hydraulic valve includes a valve cylinder positioned on the shaft and a position control device for selective and releasable securing a position of the valve cylinder on the shaft. The hydraulic valve also includes an elastic device for shifting the valve cylinder between end positions. The method further includes applying hydraulic pressure through the conduit at a selected rate (e.g., pump rate) and expanding the tubular. In an embodiment, the shaft has multiple bores for fluid passage (i.e., passage between the valve, thruster, and anchoring device). In an embodiment, the thruster and valve cylinder have elongated arms with length about equal to the length of the stroke of the thruster.

The foregoing has outlined rather broadly the features and technical advantages of the present invention in order that the detailed description of the invention that follows may be better understood. Additional features and advantages of the invention will be described hereinafter that form the subject of the claims of the invention. It should be appreciated by those skilled in the art that the conception and the specific embodiments disclosed may be readily utilized as a basis for modifying or designing other structures for carrying out the same purposes of the present invention. It should also be realized by those skilled in the art that such equivalent constructions do not depart from the spirit and scope of the invention as set forth in the appended claims.

BRIEF DESCRIPTION OF THE DRAWINGS

For a detailed description of the preferred embodiments of the invention, reference will now be made to the accompanying drawings in which.

DETAILED DESCRIPTION OF THE PREFERRED EMBODIMENTS

Figures 1A, 1B, 1C, 1D, 1E:
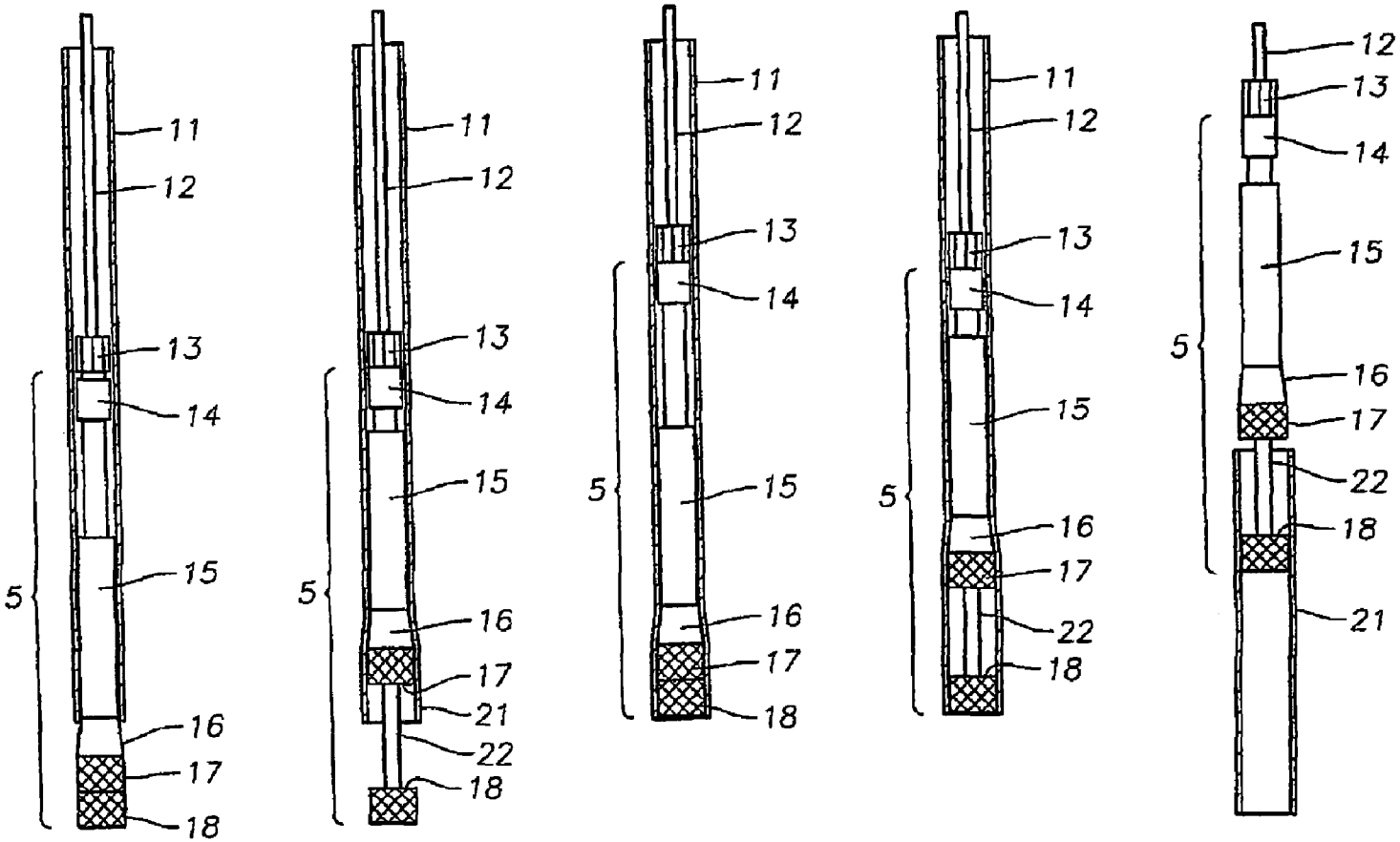
FIGS. 1A-1E illustrate a tubular expansion apparatus and a method of operation.

FIGS. 1A-1E illustrate a cycle of operation of a tubular expansion apparatus 5. As shown in FIG. 1A, tubular expansion apparatus S includes a hydraulic valve 14, a thruster 15 connected to an expansion swage 16, a swage anchoring mechanism 17 connected to expansion swage 16, and a back anchoring mechanism 18 connected to a shaft 22 as shown in FIG. 1B. Thruster 15 may include any device having a hydraulic device means that may provide a force to axially move expansion swage 16 inside expandable tubular 11 to plastically radially expand expandable tubular 11. Expandable tubular 11 includes any expandable tubular suitable for being plastically radially expanded by the application of a radial expansion force. Without limitation, examples of expandable tubulars include a liner, casing, borehole clad to seal a selected zone, or the like. For instance, the expandable tubular may be a tubular string of interconnected tubular members or a coiled tubing tubular. Expansion swage 16 may include any device that generates radial forces to plastically increase tubular diameter when it is displaced in a longitudinal direction in expandable tubular 11. Without limitation, an example of an expansion swage includes a tapered cone of a fixed or a variable diameter. Moreover, an anchoring mechanism refers to a device capable of being selectively releasably engaged with a inner surface of expandable tubular 11 and that may prevent movement of selected parts of tubular expansion apparatus 5 relative to expandable tubular 11 under applied forces during the expansion process.

In an embodiment, as shown in FIGS. 1A-1E, a tubular expansion apparatus 5 is deployed in a wellbore (not illustrated) on a drill pipe 12. It is to be understood that tubular expansion apparatus 5 is not limited to being deployed on a drill pipe but may be deployed on any suitable conduit. For instance, in an alternative embodiment, such a conduit may include a string of coiled tubing. Expandable tubular 11 may be attached to drill pipe 12 by means of a casing lock 13. Casing lock 13 includes any device capable of being releasably anchored to the inner surface of expandable tubular 11 during deployment of expandable tubular 11 in the wellbore. During the deployment of tubular expansion apparatus 5, hydraulic valve 14 and thruster 15 are in the position to commence the power stroke. Power stroke refers to a movement of expansion swage 16 relative to expandable tubular 11 in the direction corresponding to radial expansion of expandable tubular 11. After tubular expansion apparatus 5 has been located at a desired location in the wellbore, a motive fluid under pressure may be supplied down through drill pipe 12 to tubular expansion apparatus 5. Thruster 15 is actuated, and at a certain pressure, thruster 15 displaces expansion swage 16 inside expandable tubular 11 and provides expanded tubular 21 as shown in FIG. 1B. During this cycle, casing lock 13 remains engaged with the inner part of expandable tubular 11, which prevents sliding of the shaft inside expandable tubular 11. At the end of the power stroke, hydraulic valve 14 is automatically switched to commence the reset stroke. Reset stroke refers to a movement of the tubular expansion apparatus 5 relative to the tubular. Also, at the end of the first power stoke, casing lock 13 is disengaged and remains disengaged during the remainder of the expansion process.

As shown in FIG. 1C, during the reset stroke, swage anchoring mechanism 17 is engaged with the inner surface of the expanded tubular 21 and prevents movement of expansion swage 16 relative to expanded tubular 21. Back anchoring mechanism 18 is disengaged, and thruster 15 displaces back anchoring mechanism 18 inside expanded tubular 21. As shown in FIG. 1D, at the end of the reset stroke, hydraulic valve 14 automatically switches to the power stroke, i.e., back anchoring mechanism 18 is engaged, which prevents movement of shaft 22 relative to expanded tubular 21; swage anchoring mechanism 17 is disengaged; and thruster 15 is in power stroke mode displacing expansion swage 16 further into expandable tubular 11. These cycles may continue automatically until the entire length of expandable tubular 11 is expanded. As shown in FIG. 1E, at the end of expansion, expansion swage 16 departs from expanded tubular 21 by being displaced by thruster 15 against back anchoring mechanism 18. The pressure is released, and tubular expansion apparatus 5 may be removed from the wellbore.

It is to be understood that the expansion process described above in relation to FIGS. 1A-1E may be referred to as a "bottom-up" process such that the process begins at a lower end of expandable tubular 11 with expansion swage 16 propagating upwards through expandable tubular 11 for radial expansion thereof. The terms "upper" and "lower" herein refer to the orientation of a tubular member in a conventional borehole that is a deviated or a horizontal borehole. "Upper" refers to the end of the tubular member that is nearest the surface of the well. It is to be understood that tubular expansion apparatus 5 and methods of expansion using tubular expansion apparatus 5 may be applied using a technique that expands tubular expansion apparatus 5 from the upper end to the lower end.

Figure 2A:
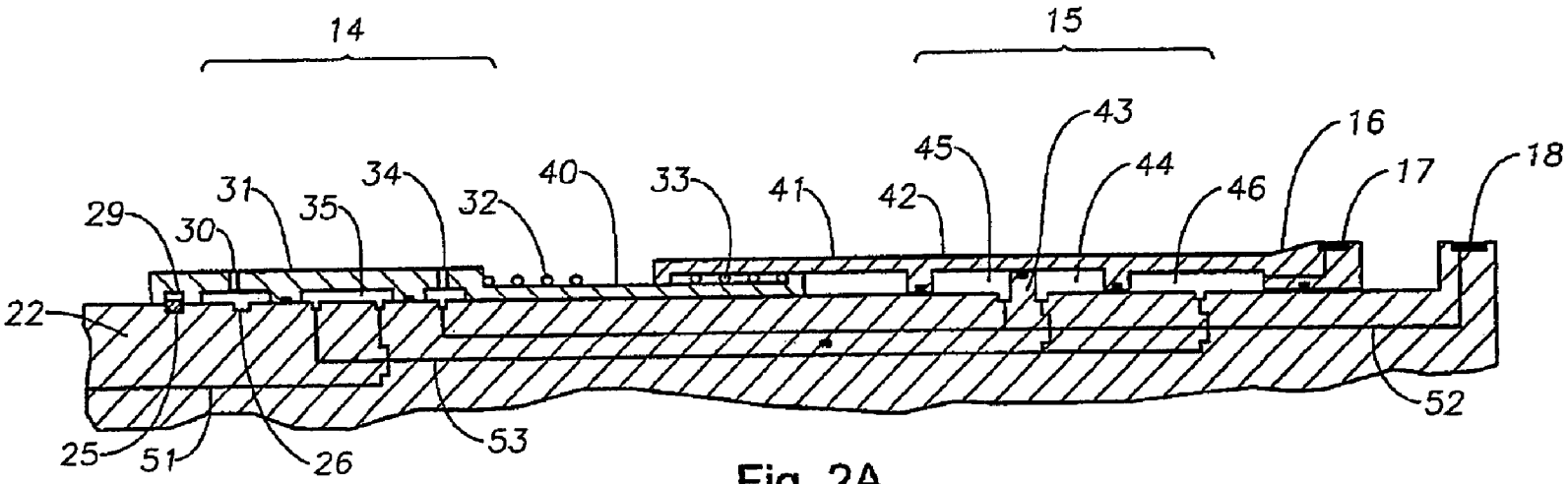
FIGS. 2A-2C illustrate a longitudinal cross-section of a tubular expansion apparatus and operation modes.

FIG. 2A shows a longitudinal cross-section of an embodiment of tubular expansion apparatus 5 having hydraulic valve 14, thruster 15, expansion swage 16, swage anchoring mechanism 17, shaft 22, and back anchoring mechanism 18. Pressure lines 51, 52, and 53 are a schematic representation of borehole passages for fluid in shaft 22.

As shown in FIG. 2A, thruster 15 includes a hydraulic drive means including a piston 43 attached to shaft 22, and a cylinder 42 slidably arranged over piston 43 and shaft 22. Cylinder 42 includes pressure chambers 44 and 45 separated by piston 43. A pressure chamber refers to a pressure sealed annular compartment, for instance between a cylinder and a shaft. Cylinder 42 is connected to expansion swage 16. Supply pressure chamber 46 is adapted to provide liquid communication between pressure line 53, expansion swage 16, and swage anchoring mechanism 17. Thruster 15 includes piston 43 and cylinder 42 having pressure chambers 44 and 45. It should be understood that although one piston 43 and one cylinder 42 are shown in FIG. 2A, any number of cylinders and/or pistons may be provided. The hydraulic rust provided by thruster 15 increases as the number of pressure chambers increases, i.e. the hydraulic force provided by the pressure chambers is additive. Thus, the number of cylinders may be selected according to the desired operational pressure and/or the desired thrust force for the tubular expansion.

Figure 3C:
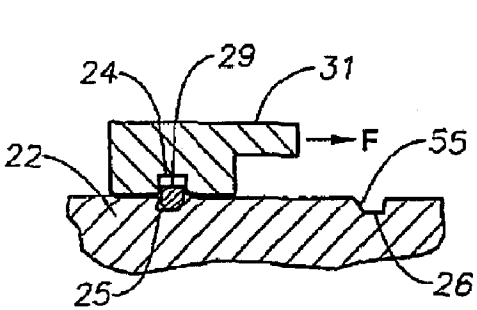
FIG. 3C illustrates engagement of the position control device.
Figure 3B:
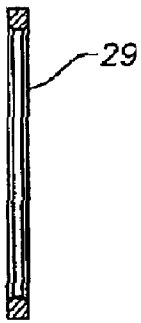
FIG. 3B illustrates a side view of the position control device.
Figure 3A:
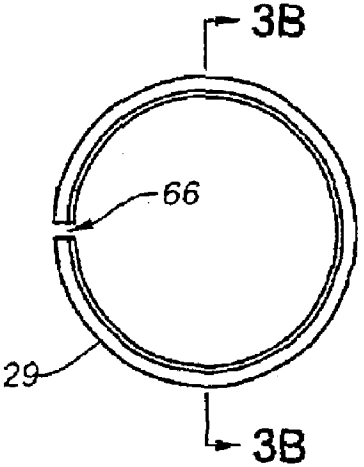
FIG. 3A illustrates an embodiment of a position control device.

Hydraulic valve 14 includes a cylinder 31 longitudinally slidably engaged with shaft 22 and forming an internal annular pressure chamber 35 surrounding shaft 22. Hydraulic valve 14 is a two-position valve with a first end position corresponding to a power stroke mode of thruster 15, and a second end position corresponding to a reset stroke of thruster 15. In an embodiment, hydraulic valve 14 includes a position control element 29 to selectively and releasably lock cylinder 31 in first or second end positions. Without limitation, examples of suitable position control elements 29 include a C-ring locking mechanism and a collet. FIGS. 3A-3C illustrate a position control element 29 that is a C-ring locking mechanism employed in hydraulic valve 14. A C-ring locking mechanism is a ring with a circular shape and a cut 66 that allows the ring to be elastically radially deformed at the radial deflection corresponding to the depth of grooves 25 and 26 provided in shaft 22. The C-ring has an initial internal diameter generally equal to the diameter of grooves 25 and 26. The C-ring is positioned in groove 24 in cylinder 31 with the depth of groove 24 not less than the thickness of the C-ring. The C-ring may be engaged or disengaged in grooves 25 and 26 in shaft 22 under the action of an axial force F applied to cylinder 31. Force F is a function of the following parameters: the stiffness of die C-ring, the depth of the groove, the wedge angle 55 of groove 26, and the friction coefficient between the groove and the C-ring. Therefore, using conventional methods of calculation, the parameters listed above may be selected to provide a desired value of the axial force F for disengagement of the C-ring out of the shaft groove.

It will be understood that the C-ring may bear against any suitable surfaces or any components having a fixed relationship with shaft 22 and/or with the valve cylinder. The C-ring may be configured to operate primarily in tension of primarily in compression. It is also to be understood that other position control elements, such as collets, snap-rings and the like, capable of selectively and releasably securing a position of the valve cylinder on the shaft, may be used.

Figure 2B:
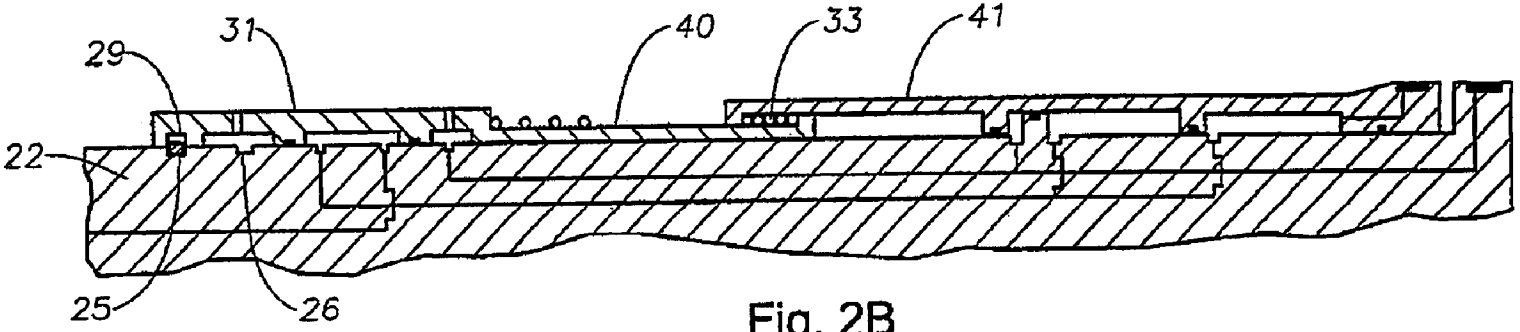
Figure 2C:
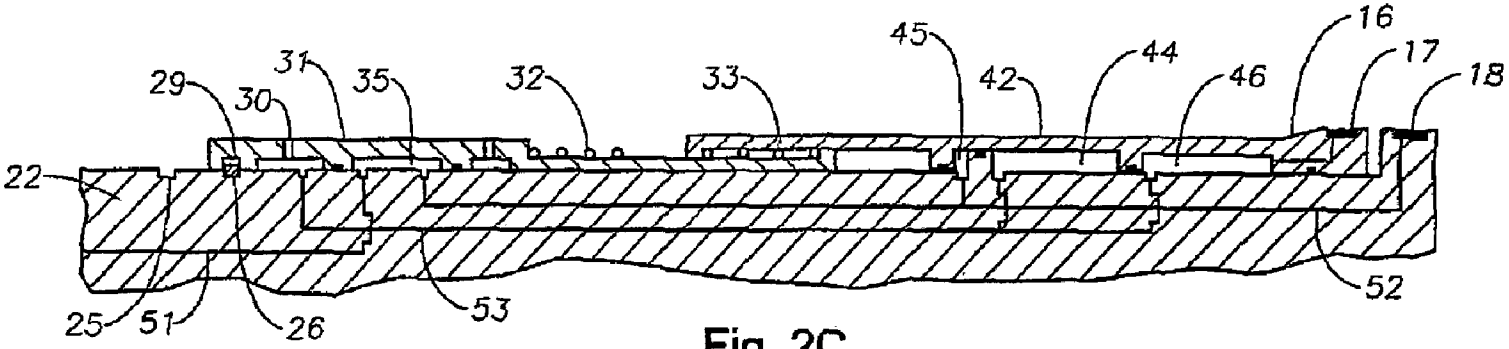

The shifting between the end positions of hydraulic valve 14 is provided by displacement of thruster 15. Both the hydraulic valve 14 and thruster 15 have elongated arms 40 and 41, respectively. Elastic devices 32 and 33 are positioned at the ends of arm 40. Any suitable elastic device may be used such as springs. In an embodiment, elastic device 32 is a spring, and elastic device 33 is a spring. The length of arm 41 is generally equal to the length of the total stroke displacement of cylinder 42 (e.g., thruster cylinder), while the length of arm 40 is generally equal to arm 41 (e.g., thruster arm) in addition to at least a combined length of the solid heights of elastic devices 32 and 33. Each elastic device 32, 33 is capable of displacing cylinder 31 from the first valve position to the second valve position and vice versa, i.e. over a length, l, between grooves 25 and 26. It is to be understood that the minimum force, F1, for shifting cylinder 31 (e.g., valve cylinder) is equal to the friction force between cylinder 31 and shaft 22 plus the weight of cylinder 31. Therefore, elastic devices 32, 33 are designed to provide a force F1 at the end of displacement l, which defines a force, F2, at the start of displacement of cylinder 31 from the first or the second position. Therefore, the C-ring design, as discussed above, is based on the axial force F for disengagement of the C-ring out of the shaft groove being equal to the force P2. The shifting of the valve from one position to the other takes place at the end of the power or reset strokes of thruster 15. As illustrated in FIG. 2B, at the end of a stroke, arm 41 (e.g., thruster arm) compresses elastic device 33 against arm 40 (e.g., valve arm) generating the force F2. Under the action of force F2, as shown in FIG. 2C, the C-ring is disengaged from groove 25, and, under the action of elastic device 33, valve cylinder 31 is shifted to the other end position, i.e. the ring is moved to groove 26.

It is to be understood that elastic devices 32 and 33 may bear against any suitable surfaces or any components having a fixed relationship with cylinder 31 and/or cylinder 42 (e.g., thruster cylinder). It is also to be understood that elastic devices 32 and 33 may be configured to operate primarily in tension or primarily in compression, with a desire including shifting cylinder 31 between first and second positions.

As shown in FIG. 2A, pressurized operating fluid is pumped through the drill pipe into main pressure line 51. Hydraulic valve 14 is in the second position corresponding to the reset stroke mode of operation. In the reset mode, pre chamber 35 provides communication between main pressure line 51 and operational pressure line 53. Operational pressure line 52 is connected with pressure chamber 45 (e.g., power stroke chamber) and with back anchoring mechanism 18. In the reset stroke mode, the operational pressure line 52 is vented through vent 34, providing liquid flow from pressure chamber 45 and from back anchoring mechanism 18. The pressure is applied through operational pressure line 53 to reset pressure chamber 44 and to supply pressure chamber 46 connected to swage anchoring mechanism 17. In this configuration, swage anchoring mechanism 17 is engaged with the inner surface of the expandable tubular (not shown) preventing movement of cylinder 42 relative to the tubular, and the back anchoring mechanism 18 is in disengaged position. The pressure applied to piston 43 urges shaft 22 to be moved further inside the tubular as shown in FIG. 2B.

As shown in FIG. 2B, at the end of the reset stroke, elastic device 33 is compressed between the ends of elongated arms 40 and 41, which generates spring force to displace the C-ring out of groove 25 and to displace cylinder 31 to the end position corresponding to the power stroke mode of operation. As shown in FIG. 2C, in this configuration, the C-ring is positioned in groove 26, the pressure chamber 35 (e.g., valve pressure chamber) provides communication between main pressure line 51 and operational line 52, and operational pressure line 53 is vented through vent 30 providing flow of the liquid from reset pressure chamber 44 and supply pressure chamber 46. Swage anchoring mechanism 17 is depressurized and disengaged from the tubular. Back anchoring mechanism 18 is under pressure provided through operational pressure line 52 and is engaged with the inner surface of the expandable tubular (not shown) preventing movement of shaft 22 relative to the tubular. The pressure is applied in pressure chamber 45 through pressure line 52, which urges cylinder 42 with expansion swage 16 to move further in the tubular providing radial expansion of the tubular. The expansion continues until elastic device 32 is compressed, and cylinder 31 is shifted in a similar manner back to the reset stroke. Thus, delivery of the pressurized fluid through pressure line 51 causes the cycles described above to be repeated automatically until the length of the tubular is expanded. It is to be understood that the automatic process may be stopped at any time by discontinuing delivery of pressure fluid and may be restarted by re-establishing delivery of pressure fluid. Without being limited by theory, the final departure of expansion swage 16 from expanded tubular 21 is safe, since expansion swage 16 is displaced from expanded tubular 21 by thruster 15 while drill pipe 12 through shaft 22 is anchored to expanded tubular 21 by back anchoring mechanism 18 as illustrated in FIG. 1E.

An advantage of the location of the anchoring mechanisms is the elimination of possible damage to the unexpanded portion of the tubular, which may cause rupture of the tubular during expansion. Therefore, the configuration of the tubular expansion apparatus with anchoring mechanisms located in the expanded portion of the tubular significantly improves reliability of the expansion system. Another advantage of positioning the anchoring mechanisms in the area of the expanded portion of the tubular is the ability to displace the swage by the thruster (at the end of the expansion process) by pushing against the anchoring mechanism engaged with the tubular, which may eliminate any propulsion of the drill pipe out of the well and may allow for the departure of the expansion swage from the tubular in a safe manner.

Although the present invention and its advantages have been described in detail, it should be understood that various changes, substitutions and alterations may be made herein without departing from the spirit and scope of the invention as defined by the appended claims. For instance, expansion swage 16 may be attached to shaft 22, and the front anchor may be designed to be engaged with the inner surface of the unexpanded portion of the pipe.

What is claimed is:

1. An apparatus for radially expanding a tubular in a wellbore, comprising:

an expansion swage;

at least one anchoring device for selective and releasable anchoring of selected parts of the apparatus to an inner surface of the tubular;

a thruster providing a force for longitudinal movement of the expansion swage inside the tubular;

a hydraulic valve for selective control of a flow of operating fluid to the thruster, wherein the hydraulic valve comprises:

a valve cylinder slidably positioned on a shaft;

a position control device for selective and releasable securing a position of the valve cylinder on the shaft;

an elastic device for shifting the valve cylinder between two end positions.

2. The apparatus of claim 1, wherein the position control device is a C-ring.

3. The apparatus of claim 1, wherein the position control device is a collet.

4. The apparatus of claim 1, wherein the elastic device is a spring.

5. The apparatus of claim 1, wherein the expansion swage is slidably positioned on the shaft.

6. The apparatus of claim 5, wherein the shaft has multiple bores for fluid passage.

7. The apparatus of claim 1, wherein at least one of the at least one anchoring device is connected to the expansion swage.

8. The apparatus of claim 1, wherein at least one of the at least one anchoring device is connected to the shaft.

9. The apparatus of claim 1, wherein the expansion swage is connected to the thruster.

10. The apparatus of claim 1, wherein the thruster comprises an elongated arm.

11. The apparatus of claim 1, wherein the hydraulic valve alternates pressure fluid delivery and withdrawal to at least one of the at least one anchoring device.

12. The apparatus of claim 1, wherein the valve cylinder comprises an elongated arm.

13. The apparatus of claim 1, wherein the thruster comprises a supply pressure chamber to provide liquid communication between a pressure control line and at least one of the at least one anchoring device.

14. The apparatus of claim 1, further comprising a casing lock for releasably anchoring the apparatus to the tubular.

15. A method for placing and expanding an expandable tubular in a wellbore, comprising:

(A) delivering the tubular and a tubular expansion apparatus to a desired location in the wellbore on a conduit having a path for conveying fluid to the tubular expansion apparatus;

(B) providing an expansion swage;

(C) providing a first anchoring device connected to the expansion swage;

(D) providing a second anchoring device connected to a shaft;

(E) providing a thruster for providing a force for longitudinal movement of the expansion swage inside the tubular and expanding the tubular;

(F) providing a hydraulic valve for automatically alternating pressure fluid delivery and withdrawal to the thruster, wherein the hydraulic valve comprises:

a valve cylinder positioned on the shaft;

a position control device for selective and releasable securing a position of the valve cylinder on the shaft; and an elastic device for shifting the valve cylinder between end positions; and (G) applying hydraulic pressure through the conduit at a selected rate and expanding the tubular.

16. The method of claim 15, wherein the conduit is a drill pipe.

17. The method of claim 15, wherein the conduit is a string of coiled tubing.

18. The method of claim 15, wherein the expandable tubular is a tubular string of interconnected tubular members.

19. The method of claim 15, wherein the expandable tubular is a coiled tubing tubular.

20. The method of claim 15, wherein the elastic device is a spring.

* * * * *